US005826466A

United States Patent [19]

Weissbach

[11] Patent Number: 5,826,466

[45] Date of Patent: Oct. 27, 1998

[54] MULTI-PURPOSE HAMMER

[76] Inventor: Edward Weissbach, P.O. Box 805, Riverhead, N.Y. 11901

[21] Appl. No.: 851,209

[22] Filed: May 5, 1997

[51] Int. Cl.[6] ..... B25D 1/00

[52] U.S. Cl. ..... 81/26; 81/23; 7/164

[58] Field of Search ..... 81/20, 23, 26, 81/177.1, 177.2, 489, DIG. 5; 7/167, 164, 143, 146, 147

[56] References Cited

U.S. PATENT DOCUMENTS

| | | | |
|---|---|---|---|
| D. 303,208 | 9/1989 | Chung | D8/81 |
| 1,411,567 | 4/1922 | Fisher | 81/23 |
| 1,737,647 | 12/1929 | Cummings | 81/26 |
| 1,840,135 | 1/1932 | Schutt | 7/164 |
| 2,501,757 | 3/1950 | Cagle | 7/164 |
| 2,542,603 | 2/1951 | Watters et al. | 81/23 |
| 4,193,433 | 3/1980 | Sickler | 81/23 |
| 4,273,172 | 6/1981 | Hoosier | 145/30 R |
| 4,290,583 | 9/1981 | Lombardi | 254/26 R |
| 4,448,230 | 5/1984 | Reed | 145/30 A |
| 4,732,058 | 3/1988 | Chung | 81/20 |
| 5,159,858 | 11/1992 | Gansen | 81/23 |
| 5,345,636 | 9/1994 | Lamons | 7/139 |

*Primary Examiner*—David A. Scherbel
*Assistant Examiner*—Joni B. Danganan
*Attorney, Agent, or Firm*—Richard L. Miller, P.E.

[57] ABSTRACT

A multi-purpose hammer that starts nails with the use of only one hand, drives nails in restricted areas, and draws circles. The hammer includes a handle, a head, and holding apparatus. The head extends generally perpendicularly from the handle, at an end thereof. The holding apparatus is associated with the head and holds the nail and includes a pair of dimples in a surface of an intermediate portion of the head. Another surface of the intermediate portion of the head has a striking surface that drives a nail in the restricted area by reducing the needed swing. And, the handle of the hammer has a plurality of grooves therealong with inch indica next thereto that function as the radius of the circle, with the nail in one dimple functioning as the center of the circle and a marking device inserted into a desired groove with the handle being swung and marking the circle.

4 Claims, 2 Drawing Sheets

FIG.1
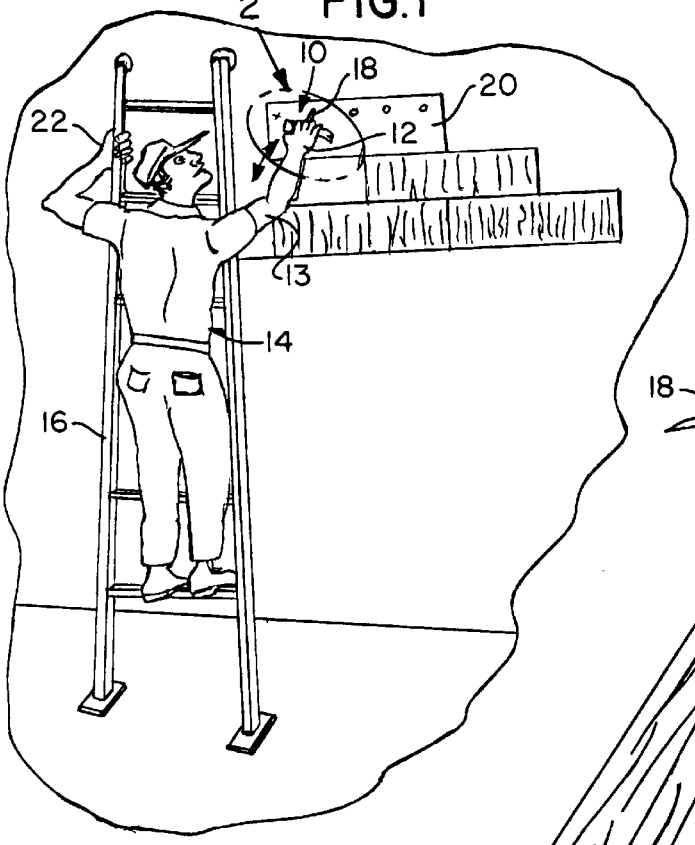
FIG.2
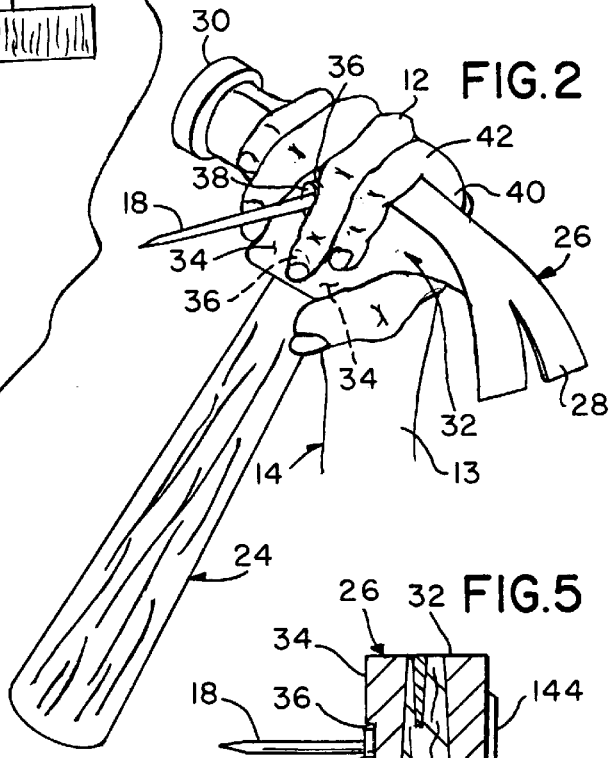
FIG.5
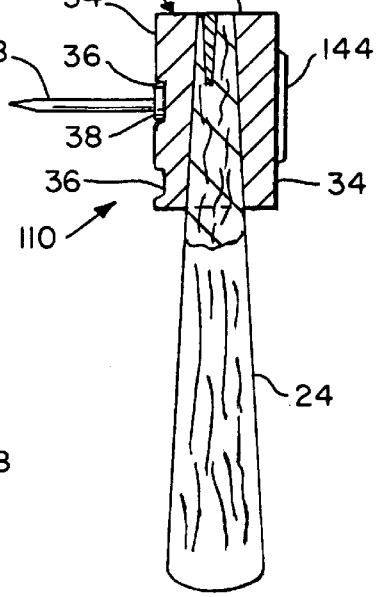
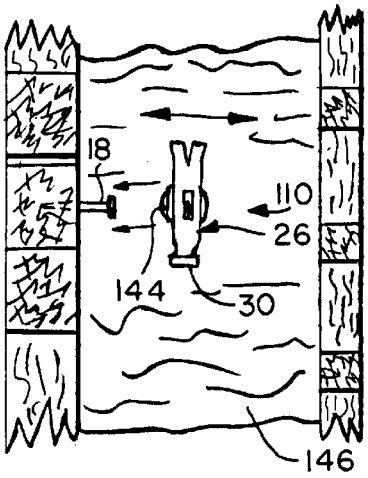
FIG.3
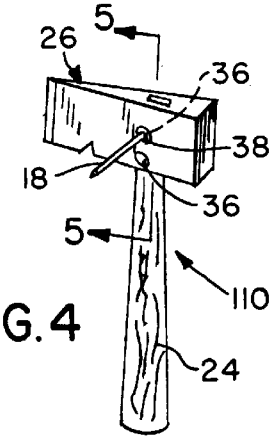
FIG.4

FIG. 6
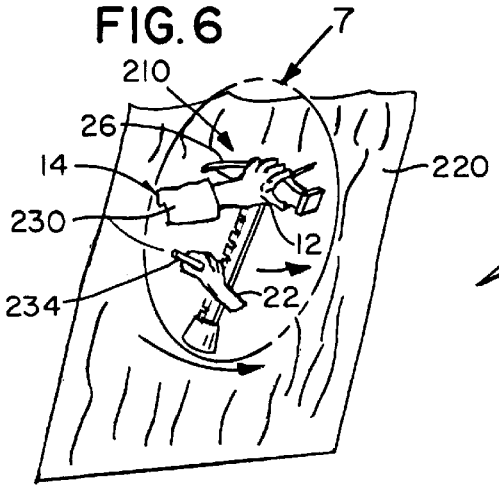
FIG. 7
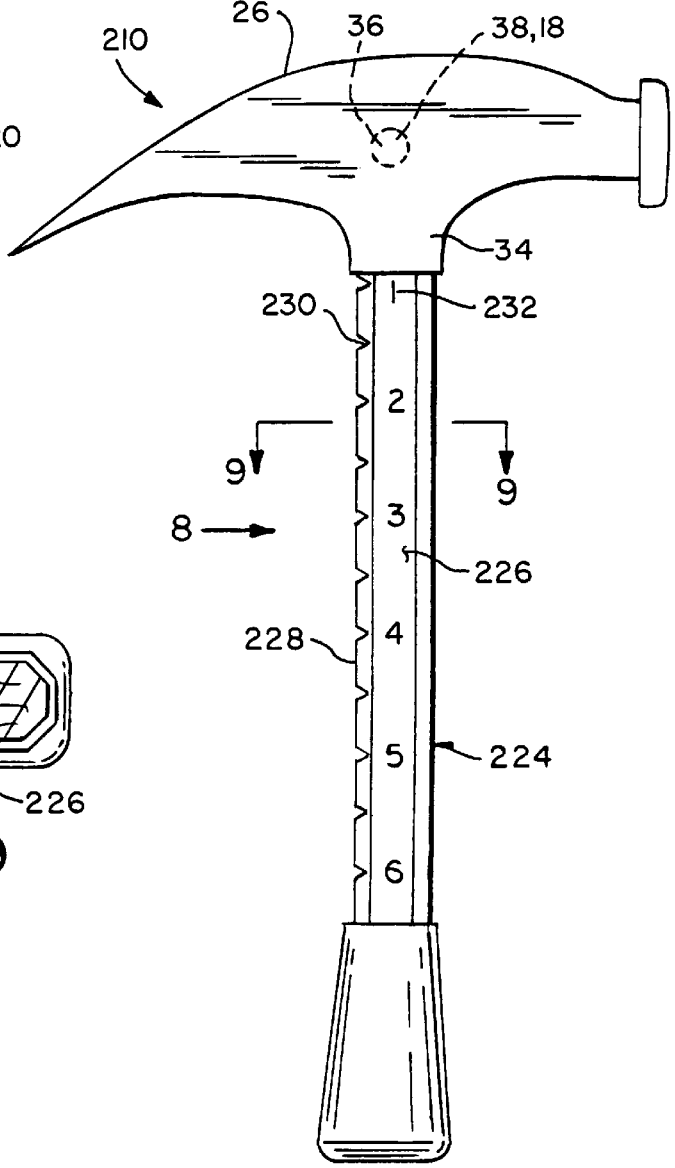
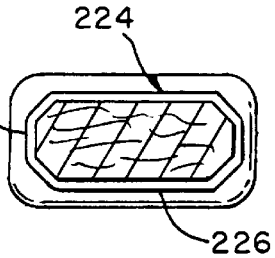
FIG. 9
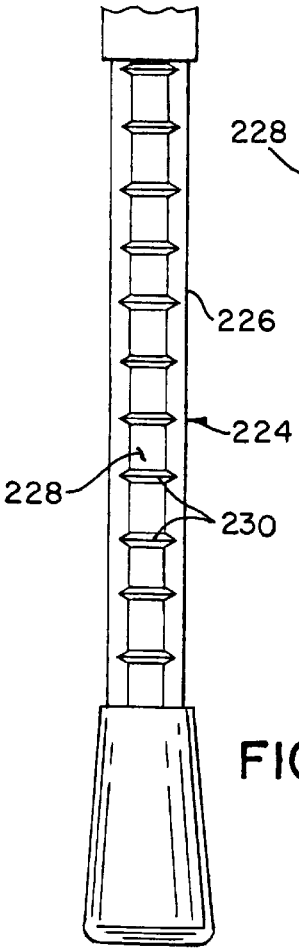
FIG. 8

MULTI-PURPOSE HAMMER

BACKGROUND OF THE INVENTION

1. Field of the Invention

The present invention relates to a hammer. More particularly, the present invention relates to a multi-purpose hammer.

2. Description of the Prior Art

Numerous innovations for hammers have been provided in the prior art that will be described. Even though these innovations may be suitable for the specific individual purposes to which they address, however, they differ from the present invention.

FOR EXAMPLE, U.S. Pat. No. Des. 303,208 to Chung teaches the ornamental design for a combined hammer, measuring gauge, and nail holder.

ANOTHER EXAMPLE, U.S. Pat. No. 4,273,172 to Hoosier teaches a hammer head that has a longitudinal groove leading from the striking face to temporarily hold a nail and has a plurality of transverse grooves to receive the nail heads and provide nail head abutment surfaces. The bottom of the longitudinal groove is stepped upwardly between the transverse grooves away from the striking surface so that finishing nails will be accommodated.

STILL ANOTHER EXAMPLE, U.S. Pat. No. 4,290,583 to Lombardi teaches a claw hammer provided with a wedge-shaped portion on the contact surface between the anvil portion and the clawed portion in order to enable the user thereof to remove nails from a surface with a minimum of effort and a reduced swing of the handle.

YET ANOTHER EXAMPLE, U.S. Pat. No. 4,448,230 to Reed teaches nail holding hammers and utilizes a socket formed in the hammer head adjacent the nail driving surface for receiving the headed end of a nail. A magnet within the socket retains the nail therein, and spaced lugs formed on the head define a nail shank support for the nail outer end. The socket axis, magnet surface, and nail supporting notch are oriented to maintain the length of the nail perpendicular to the hammer nail driving surface insuring that the nail will be set in the direction to be driven.

STILL YET ANOTHER EXAMPLE, U.S. Pat. No. 4,732,058 to Chung teaches a measuring hammer which is constructed in such a manner as to provide locations in the hammer with specific dimensions so that the hammer itself can be used to make measurements normally required in the construction field. Also, a nail holding aperture is disposed in the head portion thereof for starting a nail into the wood. Advantageously, the measuring hammer contains measurements of 1.5", 12", 16" or 24".

FINALLY, YET STILL ANOTHER EXAMPLE, U.S. Pat. No. 5,345,636 to Lamons teaches a multi-tool adjustable wrench which provides for the adaption of an adjustable wrench so that it may be used as a hammer and a wrench, without the hammer surface interfering with the wrench's utility and without exposing the adjustment mechanism to severe damage. The hammer surface is located on the wrench head rearward of the adjusting mechanism. In addition, the wrench handle is adapted to function as a screwdriver, measuring ruler, wire stripper, and T-handle. The handle and base of the wrench head form a square face. Inch and metric measuring scales are provided on the wrench jaws with auxiliary Vernier scales for accurate measurement.

It is apparent that numerous innovations for hammers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a multi-purpose hammer that avoids the disadvantages of the prior art.

ANOTHER OBJECT of the present invention is to provide a multi-purpose hammer that is simple and inexpensive to manufacture.

STILL ANOTHER OBJECT of the present invention is to provide a multi-purpose hammer that is simple to use.

BRIEFLY STATED, YET ANOTHER OBJECT of the present invention is to provide a multi-purpose hammer that starts nails with the use of only one hand, drives nails in restricted areas, and draws circles. The hammer includes a handle, a head, and holding apparatus. The head extends generally perpendicularly from the handle, at an end thereof. The holding apparatus is associated with the head and holds the nail and includes at least one dimple or a pair of dimples in a surface of an intermediate portion of the head. Another surface of the intermediate portion of the head has a striking surface that drives a nail in the restricted area by reducing the needed swing. And, the handle of the hammer has a plurality of grooves therealong with inch indica next thereto that function as the radius of the circle, with the nail in one dimple functioning as the center of the circle and a marking device inserted into a desired groove with the handle being swung and marking the circle.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of a first embodiment of the present invention being utilized to start a nail when only one hand of the user is available;

FIG. 2 is an enlarged diagrammatic perspective view of the area generally enclosed by the dotted circle identified by arrow in FIG. 1;

FIG. 3 is a diagrammatic perspective view of a second embodiment of the present invention being utilized to drive a nail in a restricted area;

FIG. 4 is an enlarged diagrammatic perspective view illustrating the present invention having a hatchet head;

FIG. 5 is an enlarged cross sectional view taken on line 5—5 in FIG. 4;

FIG. 6 is a diagrammatic perspective view of a third embodiment of the present invention being utilized to draw a circle;

FIG. 7 is an enlarged diagrammatic side elevational view of the area generally enclosed by the dotted ellipse identified by arrow 7 in FIG. 6;

FIG. 8 is an enlarged rear elevational view, with parts broken away, taken generally in the direction of arrow 8 in FIG. 7; and FIG. 9 is an enlarged cross sectional view taken on line 9—9 in FIG. 7.

LIST OF REFERENCE NUMERALS UTILIZED IN THE DRAWING

First Embodiment

10 multi-purpose hammer of the present invention

12 one hand 12 of one arm 13 of user 14

13 one arm 13 of user 14

14 user

16 ladder

18 nail

20 surface

22 another hand of user

24 handle

26 head

28 claw portion of head 26

30 anvil portion of head 26

32 intermediate portion of head 26

34 pair of surfaces of intermediate portion 32 of head 26

36 pair of dimples in one surface 34 of pair of surfaces 34 of intermediate portion 32 of the head 26

38 head of nail 18

Second Embodiment

110 multi-purpose hammer of the present invention

144 striking surface forged on another surface 34 of pair of surfaces 34 of intermediate portion 32 of head 26

146 space

Third Embodiment

210 multi-purpose hammer of the present invention

220 surface

224 modified handle

226 first face of modified handle 224

228 second face of modified handle 224

230 plurality of grooves in second face 228 of modified handle 224

232 inch indica on first face 226 of modified handle 224

234 marking device

DETAILED DESCRIPTION OF THE PREFERRED EMBODIMENT

Referring now to the figures in which like numerals indicate like parts, and particularly to FIG. 1, a first embodiment of the multi-purpose hammer of the present invention is shown generally at 10 being grabbed by one hand 12 of one arm 13 of a user 14 on a ladder 16 and starting a nail 18 into a surface 20, while another hand 22 of the user 14 holds the ladder 16 so as to allow the user 14 to start the nail 18 with only the one hand 12.

The configuration of the first embodiment of the multi-purpose hammer 10 can best be seen in FIGS. 2, and as such will be discussed with reference thereto.

The multi-purpose hammer 10 includes a handle 24 that is slender, elongated, and can be any known material suitable for its purpose.

The multi-purpose hammer 10 further includes a head 26 that extends generally perpendicularly from the handle 24, at an end thereof. The head 26 has a claw portion 28 for removing nails, an anvil portion 30 for driving nails, and an intermediate portion 32 that extends from the claw portion 28 of the head 26 to the anvil portion 30 of the head 26 and securingly receives the end of the handle 24.

The intermediate portion 32 of the head 26 has a pair of surfaces 34 thereon that are flat, oppose each other, and extend generally in the direction of the handle 24.

One surface 34 of the pair of surfaces 34 of the intermediate portion 32 of the head 26 has therein a pair of dimples 36 that are spaced-apart, aligned generally in the direction of the handle 24, and sized to receive a head 38 of the nail 18 so as to allow the head 38 of the nail 18 to rest in one dimple 36 of the pair of dimples 36 in the one surface 34 of the pair of surfaces 34 of the intermediate portion 32 of the head 26, with the nail 18 extending generally perpendicularly outwardly therefrom, with the one hand 12 of the user 14 wrapping around the intermediate portion 32 of the head 26, with a palm 40 of the one hand 12 of the user 14 abutting snugly against another surface 34 of the pair of surfaces 34 of the intermediate portion 32 of the head 26, and with fingers 42 of the one hand 12 of the user 14 extending over the intermediate portion 32 of the head 26 onto the one surface 34 of the pair of surfaces 34 of the intermediate portion 32 of the head 26 and straddling the nail 18 and maintaining the head 38 of the nail 18 in the one dimple 36 of the pair of dimples 36 in the one surface 34 of the pair of surfaces 34 of the intermediate portion 32 of the head 26, so that by merely swinging the one arm 13 of the user 14 in the direction of the nail 18, enough force is created to start the nail 18 into the surface 20.

The use of the pair of dimples 36 in the one surface 34 of the pair of surfaces 34 of the intermediate portion 32 of the head 26 allows placement of the head 38 of the nail 18 in which ever dimple 36 of the pair of dimples 36 in the one surface 34 of the pair of surfaces 34 of the intermediate portion 32 of the head 26 is comfortable for the size of the hand 40 of the user 14.

The configuration of the second embodiment of the multi-purpose hammer 110 can best be seen in FIGS. 3–5, and as such will be discussed with reference thereto.

The multi-purpose hammer 110 is identical to the multi-purpose hammer 10, with the addition of a striking surface 144, for striking the nail 18 in a restricted area, forged on the another surface 34 of the pair of surfaces 34 of the intermediate portion 32 of the head 26 so as to allow the nail 18 to be driven when space 146 available is too small to drive the nail 18 with the anvil portion 30 of the head 26.

The head 26 may also be hatchet-shaped without departing in any way from the spirit of the present invention.

The configuration of the third embodiment of the multi-purpose hammer 210 can best be seen in FIGS. 6–9, and as such will be discussed with reference thereto.

The multi-purpose hammer 210 is identical to the multi-purpose hammer 10 or the multi-purpose hammer 110, with a modification to the handle 24 making a modified handle 224.

The modified handle 224 is slender, elongated, and generally rectangular-parallelepiped-shaped, and has a first face 226 that extends generally in the direction of the another surface 34 of the pair of surfaces 34 of the intermediate portion 32 of the head 26.

The modified handle 224 further has a second face 228 that extends perpendicularly from the first face 226 of the modified handle 224.

The second face 228 of the modified handle 224 has a plurality of grooves 230 therein that are V-shaped, laterally-oriented, longitudinally spaced-apart in 0.5" increments, and start 1" from the one dimple 36 of the pair of dimples 36 in the one surface 34 of the pair of surfaces 34 of the intermediate portion 32 of the head 26.

The first face 226 of the modified handle 224 has inch indica 232 thereon that are progressive in integer increments and are disposed adjacent to corresponding grooves of the plurality of grooves 230 in the second face 228 of the modified hammer 224 so as to form a ruler of the distance from the dimple 36 of the pair of dimples 36 in the one surface 34 of the pair of surfaces 34 of the intermediate portion 32 of the head 26 along the modified handle 224 so as to allow the multi-purpose hammer 210 to draw a circle by placing the head 38 of the nail 18 into the dimple 36 of the pair of dimples 36 in the one surface 34 of the pair of surfaces 34 of the intermediate portion 32 of the head 26 and forcing the nail 18 into a surface 220 on which the circle is to be drawn so as to function as the center of the circle and holding the head 26 in the one hand 12 of the user 14 and inserting a marking device 234 in the another hand 22 of the user 14 and into a respective groove 230 of the plurality of grooves 230 in the second face 228 of the modified handle 224 corresponding to the radius of the circle desired, and as identified by the corresponding inch indicia 232 of inch indica 232 on the first face 226 of the modified handle 224, and swinging the modified handle 224 so as to thereby mark the circle.

It will be understood that each of the elements described above, or two or more together, may also find a useful application in other types of constructions differing from the types described above.

While the invention has been illustrated and described as embodied in a multi-purpose, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A multi-purpose hammer, comprising:

a) a handle;

b) a head extending generally perpendicularly from said handle, at an end thereof; said head having a claw portion for removing nails, an anvil portion for driving nails, and an intermediate portion extending from said claw portion of said head to said anvil portion of said head and securingly receiving said end of said handle; said intermediate portion of said head having a pair of surfaces thereon being flat, opposing each other, and extending generally in direction of said handle;

c) holding means associated with said head for holding a nail; said holding means including one surface of said pair of surfaces of said intermediate portion of said head having therein a pair of dimples being spaced-apart, aligned generally in direction of said handle, and sized to receive a head of the nail so as to allow the head of the nail to rest in one dimple of said pair of dimples in said one surface of said pair of surfaces of said intermediate portion of said head, with the nail extending generally perpendicularly outwardly therefrom, with one hand of a user wrapping around said intermediate portion of said head, with a palm of the one hand of the user abutting snugly against another surface of said pair of surfaces of said intermediate portion of said head, and with fingers of the one hand of the user extending over said intermediate portion of said head onto said one surface of said pair of surfaces of said intermediate portion of said head and straddling the nail and maintaining the head of the nail in said one dimple of said pair of dimples in said one surface of said pair of surfaces of said intermediate portion of said head, so that by merely swinging the one arm of the user in direction of the nail, enough force is created to start the nail into a surface; said pair of dimples in said one surface of said pair of surfaces of said intermediate portion of said head allows placement of the head of the nail in which ever dimple of said pair of dimples in said one surface of said pair of surfaces of said intermediate portion of said head is comfortable for size of the one hand of the user; said handle having a first face extending generally in direction of another surface of said pair of surfaces of said intermediate portion of said head; said handle further having a second face extending perpendicularly from said first face of said handle; said second face of said handle having a plurality of grooves therein being V-shaped, laterally-oriented, longitudinally spaced-apart in 0.5" increments, and starting 1" from said one dimple of said pair of dimples in said one surface of said pair of surfaces of said intermediate portion of said head; and d) a striking surface for striking the nail in a restricted area; said striking surface being forged on said another surface of said pair of surfaces of said intermediate portion of said head so as to allow the nail to be driven when space available is too small to drive the nail with said anvil portion of said head.

2. The hammer as defined in claim 1, wherein said handle is slender and elongated.

3. The hammer as defined in claim 1, wherein said head is hatchet-shaped.

4. The hammer as defined in claim 1, wherein said first face of said handle has inch indicia thereon that are progressive in integer increments and are disposed adjacent to corresponding grooves of said plurality of grooves in said second face of said hammer so as to form a ruler of distance from a dimple of said pair of dimples in said one surface of said pair of surfaces of said intermediate portion of said head along said handle so as to allow said multi-purpose hammer to draw a circle by placing the head of the nail into said dimple of said pair of dimples in said one surface of said pair of surfaces of said intermediate portion of said head and forcing said nail into a surface on which the circle is to be drawn so as to function as center of the circle and holding said head in the one hand of the user and inserting a marking device in another hand of the user and into a respective groove of said plurality of grooves in said second face of said handle corresponding to radius of the circle desired, and as identified by corresponding inch indicia of said inch indicia on said first face of said handle, and swinging said handle so as to thereby mark the circle on the surface.

* * * * *